US006896208B2

(12) United States Patent
Kuegler

(10) Patent No.: US 6,896,208 B2
(45) Date of Patent: May 24, 2005

(54) FUEL INJECTION SYSTEM FOR AN INTERNAL COMBUSTION ENGINE

(75) Inventor: Thomas Kuegler, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/468,475

(22) PCT Filed: Nov. 11, 2002

(86) PCT No.: PCT/DE02/04160

§ 371 (c)(1),
(2), (4) Date: Jan. 28, 2004

(87) PCT Pub. No.: WO03/054374

PCT Pub. Date: Jul. 3, 2003

(65) Prior Publication Data

US 2004/0144364 A1 Jul. 29, 2004

(30) Foreign Application Priority Data

Dec. 20, 2001 (DE) ..... 101 62 651

(51) Int. Cl.[7] ..... F02M 45/00

(52) U.S. Cl. ..... 239/533.4; 239/533.3; 239/533.11; 239/533.9; 239/124; 239/102.2; 123/458

(58) Field of Search ..... 239/124, 125, 239/102.2, 533.12, 533.11, 533.3, 533.4, 533.7, 533.9, 88, 89; 123/472, 446, 458

(56) References Cited

U.S. PATENT DOCUMENTS 4,572,433 A * 2/1986 Deckard ..... 239/88
4,976,245 A * 12/1990 Takahashi et al. ..... 123/506
5,647,536 A * 7/1997 Yen et al. ..... 239/90
5,765,755 A * 6/1998 Peters et al. ..... 239/124
5,899,389 A * 5/1999 Pataki et al. ..... 239/533.2

FOREIGN PATENT DOCUMENTS

| | | |
|---|---|---|
| DE | 38 24 467 A | 1/1990 |
| DE | 41 23 721 C | 6/1992 |
| DE | 100 40 738 A | 3/2001 |
| EP | 1 069 308 A | 1/2001 |
| EP | 1 087 129 A | 3/2001 |

* cited by examiner

*Primary Examiner*—Dinh Q. Nguyen
(74) *Attorney, Agent, or Firm*—Ronald E. Greigg

(57) ABSTRACT

For each cylinder of the internal combustion engine, the fuel injection system has one high-pressure fuel pump with a pump work chamber and one fuel injection valve communicating with the pump work chamber. A control valve actuated by means of a piezoelectric actuator control connection of the pump work chamber with a relief region. The fuel injection valve has a first injection valve member, by which at least one first injection opening is controlled and which is movable by the pressure generated in the pump work chamber in an opening direction, counter to a closing force. Inside the hollow first injection valve member, a second injection valve member is guided displaceably, by which at least one second injection opening is controlled and which is movable in an opening direction by the pressure prevailing in the pressure chamber, counter to a closing force; the second injection valve member is urged in the closing direction at least indirectly by the pressure prevailing in a fuel-filled control pressure chamber which is controlled variably as a function of engine operating conditions.

20 Claims, 3 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 02/04160 filed on Nov. 11, 2002.

BACKGROUND OF THE INVENTION

1. Field of the Invention

The invention is directed to an improved fuel injection system for an internal combustion engine and more particularly to such a system having a high pressure fuel pump and a fuel injection valve for each engine cylinder.

2. Description of the Prior Art

One fuel injection system known from German Patent Disclosure DE 198 35 494 A1 has one high-pressure fuel pump and one fuel injection valve communicating with it for each cylinder of the engine. The high-pressure fuel pump has a pump piston, driven in a reciprocating motion by the engine, that defines a pump work chamber which communicates with a pressure chamber of the fuel injection valve. The fuel injection valve has an injection valve member, by which at least one injection opening is controlled and which is movable, urged by the pressure prevailing in the pressure chamber, counter to a closing force in an opening direction to uncover the at least one injection opening. By means of a control valve actuated by a piezoelectric actuator, a connection of the pump work chamber with a relief chamber is controlled at least indirectly in order to control the fuel injection. When the pressure in the pump work chamber and thus in the pressure chamber of the fuel injection valve reaches the opening pressure, the injection valve member moves in the opening direction and uncovers the at least one injection opening. The injection cross section, which is controlled in the process by the injection valve member, is always the same size. This does not enable optimal fuel injection under all operating conditions of the engine.

SUMMARY OF THE INVENTION

The fuel injection system of the invention has the advantage over the prior art that by means of the second injection valve member with the at least one second injection opening, an additional injection cross section can be uncovered or closed, so that the injection cross section can be adapted optimally to the engine operating conditions. The control of the injection cross section is effected in a simple way by means of the variable pressure in the control pressure chamber.

Other advantageous features and refinements of the fuel injection system of the invention are disclosed. One embodiment according to claim 5 enables an extensive pressure equalization at the control valve member. Another embodiment enables a simple generation of the pressure in the control pressure chamber. Other embodiments enables optimal adaptation of the injection cross section to the load and/or rpm of the engine, and make combustion with low noise and low pollutant emissions from the engine possible.

BRIEF DESCRIPTION OF THE DRAWINGS

The invention is more fully described herein below, with reference to the drawings, in which.

DESCRIPTION OF THE PREFERRED EMBODIMENT

Figure 1:
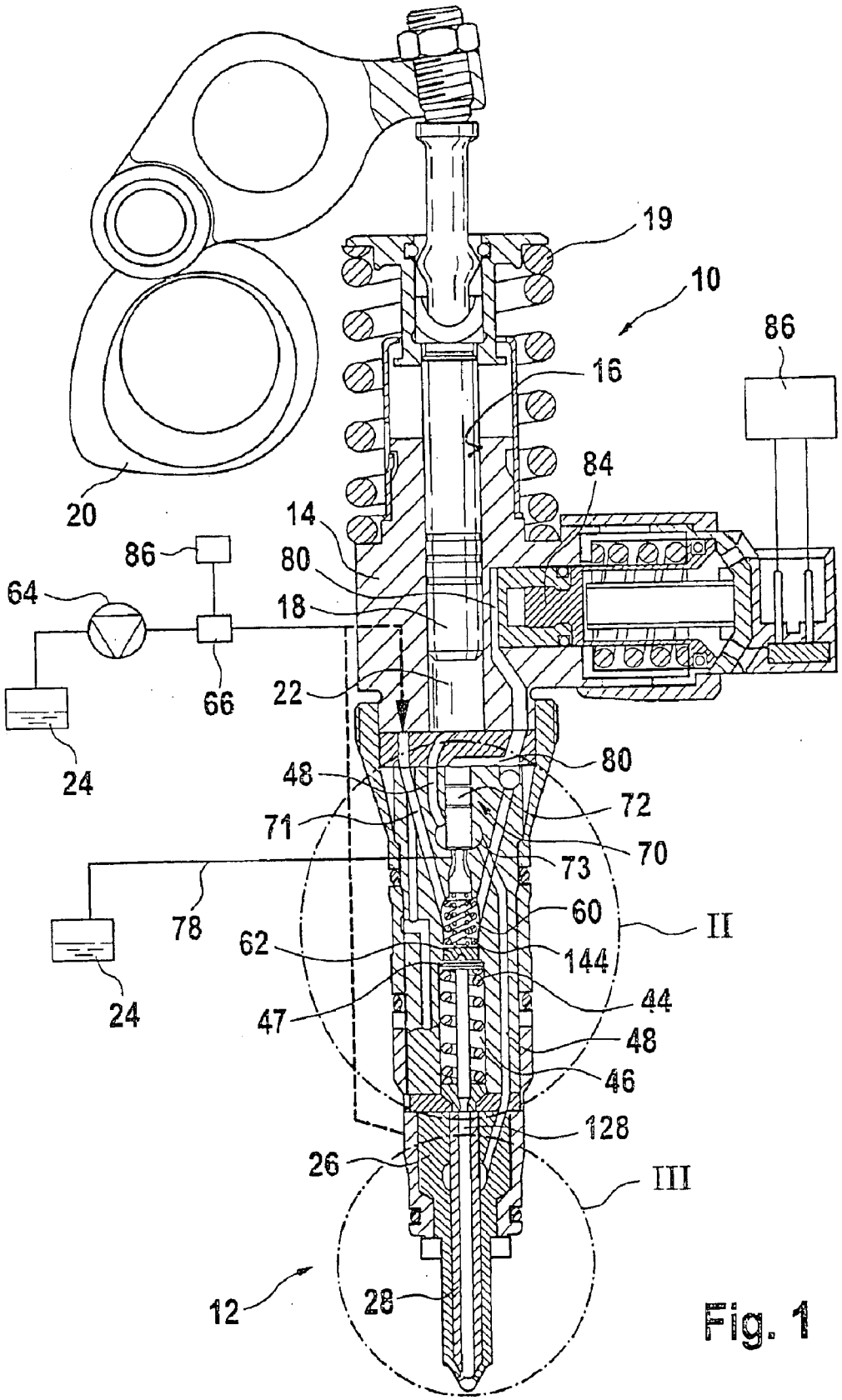
FIG. 1 shows a fuel injection system for an internal combustion engine in a schematic longitudinal section.
Figure 2:
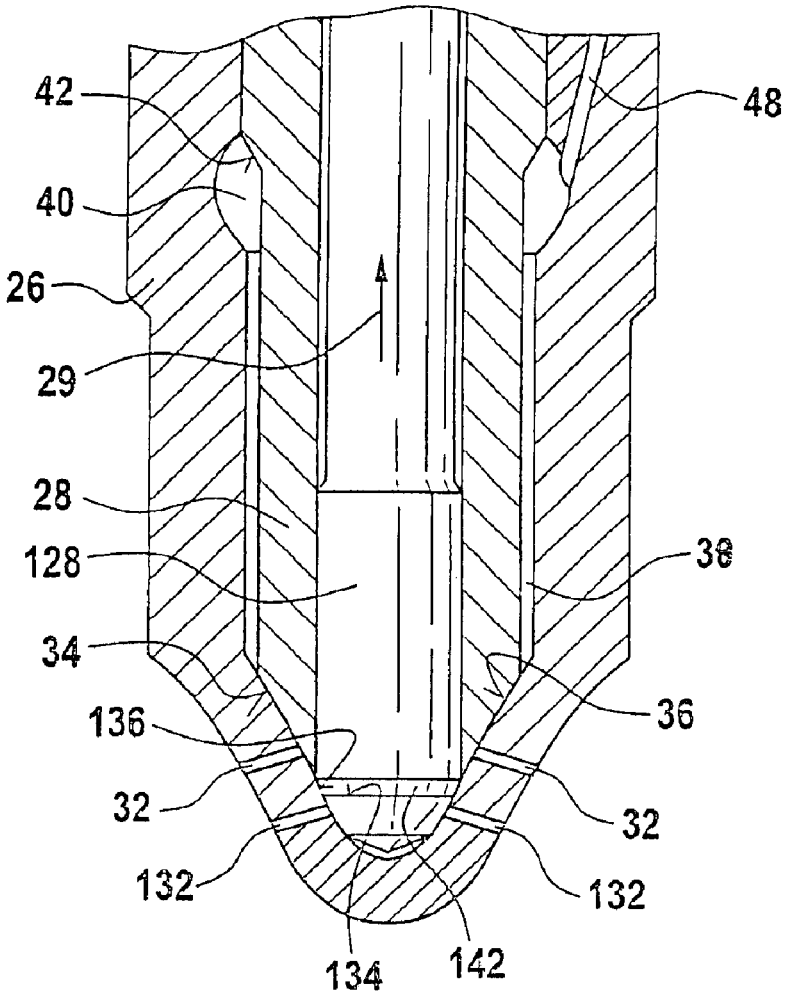
FIG. 2 shows an enlarged view of a detail, marked II in FIG. 1, of the fuel injection system.
Figure 3:
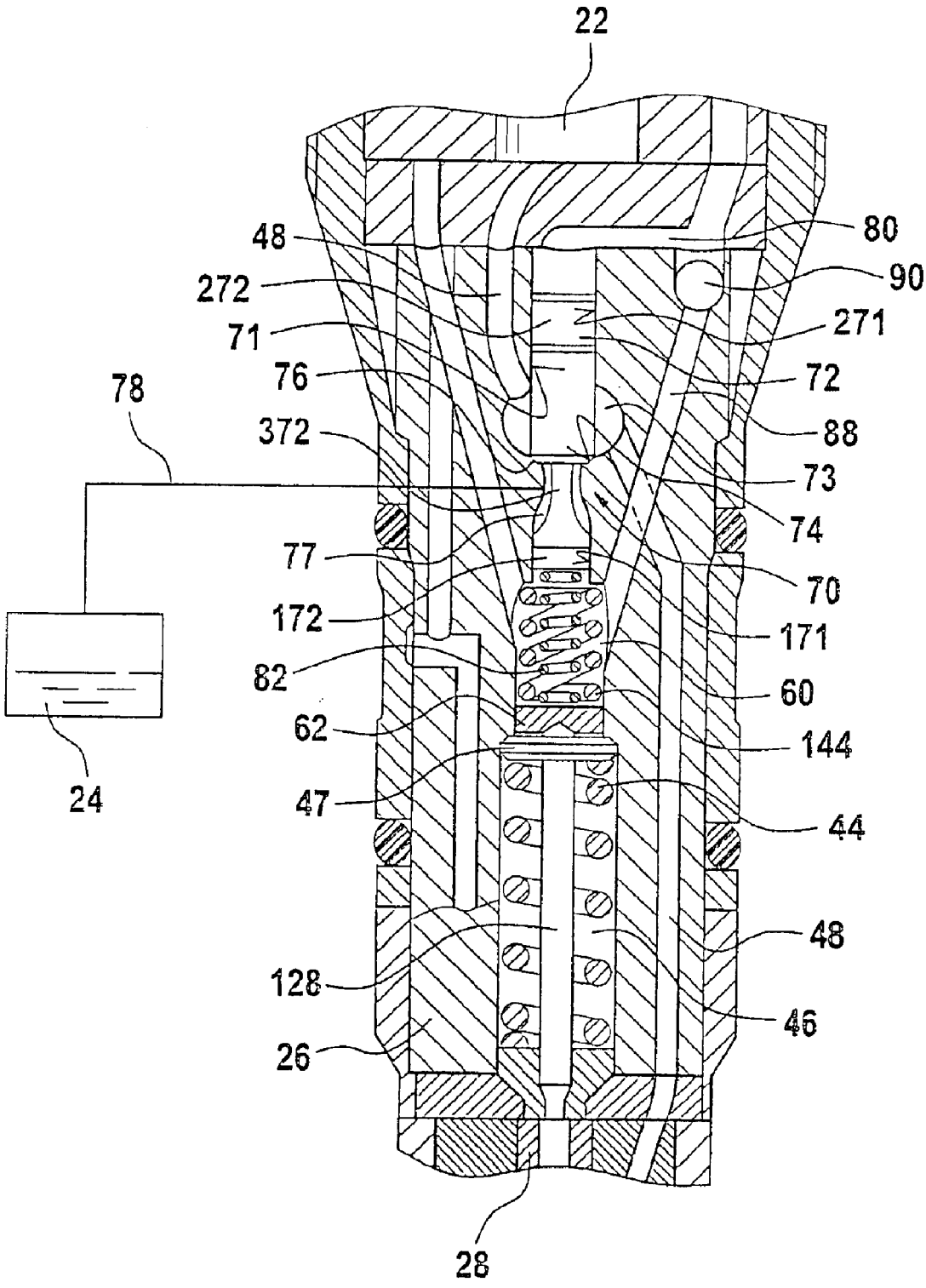
FIG. 3 shows an enlarged view of a detail, marked III in FIG. 1, of the fuel injection system.

In FIGS. 1–3, a fuel injection system for an internal combustion engine of a motor vehicle is shown. The engine is preferably a self-igniting engine. The fuel injection system is embodied as a so-called unit fuel injector or as a pump-line-nozzle system and for each cylinder of the engine has one high-pressure fuel pump 10 and one fuel injection valve 12 communicating with it. In an embodiment as a pump-line-nozzle system, the high-pressure fuel pump 10 is disposed remote from the fuel injection valve 12 and is connected to it via a line. In the exemplary embodiment shown, the fuel injection system is embodied as a unit fuel injector system, in which the high-pressure fuel pump 10 and the fuel injection valve 12 communicate directly with one another and form a structural unit. The high-pressure fuel pump 10 has a pump piston 18, which is tightly guided in a cylinder bore 16 in a pump body 14 and is driven in a reciprocating motion by a cam 20 of an engine camshaft, counter to the force of a restoring spring 19. In the cylinder 16, the pump piston 18 defines a pump work chamber 22, in which fuel is compressed at high pressure in the pumping stroke of the pump piston 18. In the intake stroke of the pump piston 18, in a manner not shown in detail, fuel is delivered to the pump work chamber 22 from a fuel tank 24 of the motor vehicle.

The fuel injection valve 12 has a valve body 26, as shown in FIGS. 1 and 3, which may be in multiple parts and in which a first injection valve member 28 is guided longitudinally displaceably in a bore 30. As shown in FIG. 2, the valve body 26, in its end region toward the combustion chamber of the engine cylinder, has at least one first and preferably a plurality of first injection openings 32, which are distributed over the circumference of the valve body 26. The first injection valve member 28, in its end region toward the combustion chamber, has a sealing face 34, approximately conical for instance, which cooperates with a valve seat 32 36 embodied in the valve body 26, in its end region toward the combustion chamber, and from which or downstream of which the first injection openings 36 lead away. In the valve body 26, between the injection valve member 28 and the bore 30 toward the valve seat 36, there is an annular chamber 38, which in its end region remote from the valve seat 36 changes over, as a result of a radial enlargement of the bore 30, into a pressure chamber 40 that surrounds the first injection valve member 28. At the level of the pressure chamber 40, as a result of a cross-sectional reduction, the first injection valve member 28 has a pressure shoulder 42. The end of the first injection valve member 28 remote from the combustion chamber is engaged by a first prestressed closing spring 44, by which the first injection valve member 28 is pressed toward the valve seat 36. The first closing spring 44 is disposed in a spring chamber 46 of the valve body 26 that adjoins the bore 30.

The first injection valve member 28 of the fuel injection valve 12 is embodied as hollow, and in it, a second injection valve member 128 is guided displaceably in a bore embodied coaxially in the injection valve member 28. By means of the second injection valve member 128, at least one second injection opening 132 in the valve body 26 is controlled. The at least one second injection opening 132 is offset toward the combustion chamber, in the direction of the longitudinal axis of the injection valve members 28, 128, from the at least one first injection opening 32. The second injection valve member 128, in its end region toward the combustion chamber, has a sealing face 134, which is for instance conical, and which cooperates with a valve seat 136 which is embodied in the valve body 26, in the end region thereof toward the combustion chamber, and from which valve seat and downstream of which the second injection openings 132 lead away. The second injection valve member 128 can be embodied in two parts and can have one part, toward the combustion chamber, that has the sealing face 134 and a second part, adjoining the first part, in the direction away from the combustion chamber. Near the end toward the combustion chamber of the second injection valve member 128, a pressure face 142 is formed on it, and the pressure prevailing in the pressure chamber 40 acts on this face when the first injection valve member 28 is open.

As shown in FIGS. 1 and 3, a control pressure chamber 60 is embodied in the valve body 26, adjoining the spring chamber 46 in the direction away from the combustion chamber, and in it a second closing spring 144 is disposed that acts on the second injection valve member 128. In diameter, the control pressure chamber 60 is embodied as somewhat smaller than the spring chamber 46. The first injection valve member 28 protrudes with its end into the spring chamber 46 and is braced on the first closing spring 44. The first closing spring 44 is braced, by its end remote from the first injection valve member 28, on a sleeve or bush 47 disposed between the spring chamber 46 and the control pressure chamber 60. The bush 47 in turn is braced on an annular shoulder, formed as a result of the diameter reduction at the transition from the spring chamber 46 to the control pressure chamber 60. The sleeve 46 can be press-fitted into the spring chamber 46 and thus fixed, or alternatively can be displaceable in the spring chamber 46 in the direction of the longitudinal axis of the first injection valve member 28. The second injection valve member 128 protrudes through the bush 47 into the control pressure chamber 60 and is braced on a control piston 62 that defines the control pressure chamber 60 toward the spring chamber 46. The second closing spring 144 is braced on the side of the control piston 62 that defines the control pressure chamber 60. With its end remote from the control piston 62, the second closing spring 144 is braced on the bottom of the control pressure chamber 60.

Fuel under pressure is supplied to the control pressure chamber 60, for instance by means of a feed pump 64. The feed pump 64 can furthermore serve to pump fuel into the pump work chamber 22 in the intake stroke of the pump piston 18. The pressure in the control pressure chamber 60 is adjusted variably as a function of engine operating conditions, such as rpm, load, temperature, and others. To that end, the feed pump 64 can be operated accordingly with a variable rpm, or between the feed pump 64 and the control pressure chamber 60 a relief valve 66 can be provided, by means of which the pressure in the control pressure chamber 60 is controlled; that is, the relief valve 66 opens or closes a communication with a low-pressure region.

From the pump work chamber 22, a connection 48 leads through the pump body 14 and the valve body 26 into the pressure chamber 40 of the fuel injection valve 12. The connection 48 is controlled by a control valve 70. The control valve 70 has a piston like control valve member 72 that is tightly guided in a bore 71 of the valve body 26, which bore adjoins the control pressure chamber 60. The bore 71 has an annular chamber 73, formed by a radial enlargement and surrounding the control valve member 72, and one part of the connection 48 leading to the pump work chamber 22 and another part of the connection 48 leading to the pressure chamber 40 discharge into this annular chamber. At the transition, pointing toward the control pressure chamber 60, from the annular chamber 73 to the bore 71, a valve seat 74 is formed, with which the control valve member 72 cooperates by means of a sealing face 76 embodied on it. The portion 171 of the bore 71 that originates at the annular chamber 73 and leading to the control pressure chamber 60 has a somewhat smaller diameter than the portion 271 of the bore 71 that originates at the annular chamber 73 remote from the control pressure chamber 60. The control valve member 72 accordingly has a smaller diameter in its region 172 that is guided in the portion 171 of the bore 71 than in its region 272 guided in the portion 271 of the bore 71. The sealing face 76 of the control valve member 72 is formed at the transition between the two regions 172 and 272. Between the sealing face 76 and the region 172 of the control valve member 72 guided in the portion 171 of the bore 71, the control valve member 72 has a region 372 of greatly reduced diameter, so that there is an annular chamber 77 between the region 372 of the control valve member 72 and the portion 171 of the bore 71. The annular chamber 77 has a communication with a low-pressure region, which by way of example may be a return 78 into the fuel tank 24. The spring chamber 46 likewise communicates with the return 78. When the control valve member 72 is in its closed position, in which it rests with its sealing face 76 on the valve seat 74, the annular chamber 73 is disconnected from the annular chamber 77, and the pump work chamber 22 is disconnected from the return 78, so that pressure can build up in the pump work chamber 22 in accordance with the stroke of the pump piston 18. When the control valve member 72 is in an open position, in which the control valve member has lifted with its sealing face 76 from the valve seat 74, the annular chamber 73 communicates with the annular chamber 77, so that from the pump work chamber 22, fuel can flow out via the return 78, and pressure cannot build up in the pump work chamber 22.

On the side of the control valve member 72 remote from the control pressure chamber 60, an actuator pressure chamber 80 which is defined by the control valve member 72 is formed either in the valve body 26 or the pump body 14 or between them. The control valve member 72 is thus urged in the closing direction by the pressure prevailing in the actuator pressure chamber 80. In the opening direction, the control valve member 72 is urged by the pressure prevailing in the control pressure chamber 60 and moreover by a restoring spring 82 fastened between the control piston 62 and the control valve member 72. The pressure in the actuator pressure chamber 80 is controlled by a piezoelectric actuator 84, which as a function of an electrical voltage applied to it changes its size and particularly its length and thereby changes the pressure in the actuator pressure chamber 80. The actuator 84 communicates with an electronic control unit 86, by which the voltage applied to the actuator 84 is furnished. The actuator 84 can communicate with the actuator pressure chamber 80 via a hydraulic coupler, in order to be capable of amplifying a relatively slight change in length of the actuator 84 and bring about relatively major pressure changes in the actuator pressure chamber 80. If a high pressure prevails in the actuator pressure chamber 80, the control valve member 72 is then in its closed position, counter to the pressure prevailing in the control pressure chamber 60 and counter to the force of the restoring spring 82, so that the pump work chamber 22 is disconnected from the return 78. When a slight pressure prevails in the actuator pressure chamber 80, then the control valve member 72, as a result of the pressure prevailing in the control pressure chamber 60 and as a result of the restoring spring 82, is in its open position, so that the pump work chamber 22 communicates with the return 78. By means of the control unit 86, the feed pump 64 and the relief valve 66 are also controlled, in order to adjust the pressure prevailing in the control pressure chamber 60 as a function of engine operating conditions.

Between the actuator pressure chamber 80 and the control pressure chamber 60, a connection 88 is provided, in which a check valve 90 opening toward the actuator pressure chamber 80 is disposed. If the pressure in the control pressure chamber 60 is higher than in the actuator pressure chamber 80, the check valve 90 opens, so that the actuator pressure chamber 80 can be filled with fuel. If the pressure in the actuator pressure chamber 80 is higher than in the control pressure chamber 60, the check valve 90 closes, so that the actuator pressure chamber 80 is disconnected from the control pressure chamber 60.

The function of the fuel injection system will now be described. In the intake stroke of the pump piston 18, the control valve member 72 is in its open position; the annular chamber 77 has a communication with the feed pump 64, so that fuel from the fuel tank 24 reaches the pump work chamber 22. In the pumping stroke of the pump piston 18, the onset of the fuel injection is defined by the fact that the control valve member 72 moves into its closed position. To that end, an increased voltage is applied to the actuator 84 by the control unit 86, so that the pressure in the actuator pressure chamber 80 is increased, and the control valve member 72 reaches its closed position. In that position, the pump work chamber 22 is disconnected from the return 78, and high pressure builds up in it in accordance with the stroke of the pump piston 18.

Once the pressure in the pump work chamber 22 and thus in the pressure chamber 40 of the fuel injection valve 12 is so high that the pressure force, generated by it on the first injection valve member 28 via the pressure shoulder 42, is greater than the force of the first closing spring 44, the fuel injection valve 12 opens, because the first injection valve member 28 lifts with its sealing face 34 from the valve seat 36 and uncovers the at least one injection opening 32. If a high pressure prevails in the control pressure chamber 60, then the closing force exerted by the pressure prevailing in the control pressure chamber 60, by the second closing spring 144, and by the restoring spring 82 on the control piston 62 and thus on the second injection valve member 128 is greater than the force exerted on the second injection valve member 128 by the pressure prevailing in the pressure chamber 40 via the pressure face 142, so that the second injection valve member 128 remains in its closed position. Thus at the fuel injection valve 12, only a portion of the total injection cross section is opened by the first injection openings 32, so that correspondingly only a slight fuel quantity is injected.

If the second injection valve member 128 is intended to open as well, then a slight pressure is set in the control pressure chamber 60, so that the force exerted in the closing direction on the control piston 62 and thus the second injection valve member 128 by the pressure prevailing in the control pressure chamber 60, by the second closing spring 144, and by the restoring spring 82 is less than the force in the opening direction exerted on the second injection valve member 128 via the pressure face 142 by the pressure prevailing in the pressure chamber 40, so that in addition to the first injection valve member 28, the second injection valve member 128 also opens and uncovers the second injection openings 132. Thus the entire injection cross section is uncovered at the fuel injection valve 12, and a greater fuel quantity is injected. The end of the fuel injection is determined by the fact that the voltage at the actuator 84 is reduced by the control unit 86, and as a result the pressure in the actuator pressure chamber 80 is reduced, so that because of the pressure prevailing in the control pressure chamber 60 and the force of the restoring spring 82, the control valve member 72 moves into its open position. The pump work chamber 22 then communicates with the return 78, and high pressure can no longer build up in it. The first injection valve member 28 then closes as a consequence of the force of the first closing spring 44. Once the first injection valve member 28 rests with its sealing face 34 on the valve seat 36, the pressure face 142 of the second injection valve member 128 is disconnected from the pressure chamber 40, so that the second injection valve member 128 also closes, as a consequence of the force of the second closing spring 144. It can also be provided that there is a stroke stop on the first injection valve member 28 for the second injection valve member 128, by means of which stop the opening reciprocating motion of the second injection valve member 128 is limited. Once the first injection valve member 28 has opened, the second injection valve member 128 can also open, until it comes to rest on the stroke stop. When the first injection valve member 28 closes, then via its stroke stop, the second injection valve member 128 is necessarily closed as well.

It can be provided that the injection cross sections formed by the first injection openings 32 and the second injection openings 132 are at least approximately the same size, so that when only the first injection valve member 28 opens, half of the total injection cross section is uncovered. Alternatively, it can be provided that the first injection openings 32 form a larger or smaller injection cross section than the second injection openings 132.

Figure 4:
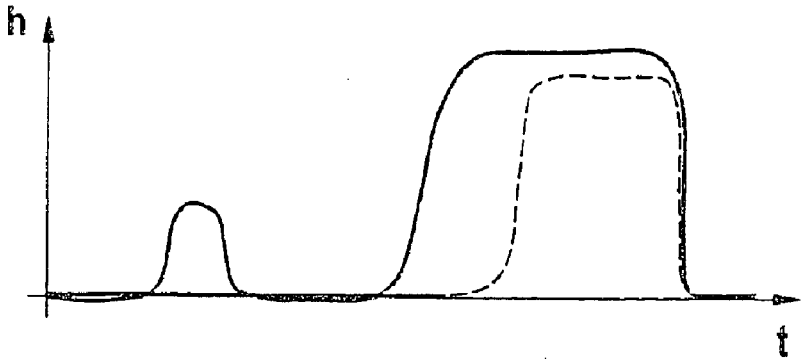
FIG. 4 shows stroke courses of injection valve members of the fuel injection system over time during one injection cycle.

In FIG. 4, the course of the opening stroke h for the first injection valve member 28 is plotted with a solid line and for the second injection valve member 128 with a dashed line, over one injection cycle over the time t. It can be provided that at the onset of the fuel injection, the control valve member 72 is put into its closed position by setting a high pressure in the actuator pressure chamber 80, so that the pump work chamber 22 is disconnected from the return 78. In the control pressure chamber 60, a high pressure is set, so that at a slight pumping stroke of the pump piston 18, initially only the first injection valve member 28 opens, and at the fuel injection valve 12, only a portion of the total injection cross section is uncovered. A preinjection of a slight fuel quantity then occurs through only the first injection openings 32. Next, by means of the control unit 86, the voltage at the actuator 84 is reduced, so that the pressure in the actuator pressure chamber 80 drops, and the control valve member 72 assumes its open position, so that the pump work chamber 22 is relieved, and the first injection valve member 28 closes and the fuel injection is interrupted. Next, the voltage at the actuator 84 is increased by the control unit 86, so that as a consequence of the increased pressure in the actuator pressure chamber 80, the control valve member 72 assumes its closed position again. As the pumping stroke of the pump piston 18 increases, the pressure in the control pressure chamber 60 can be decreased by the control unit 86, so that the closing force on the second injection valve member 128 is reduced and the second injection valve member 128 additionally opens, so that at the fuel injection valve 12, the entire injection cross section is uncovered, and a main injection of a large fuel quantity ensues. The pressure in the control pressure chamber 60 can already be decreased at the onset of the main injection by the control unit 86, so that the second injection valve member 128 opens only after a slight delay after the first injection valve member 28. Alternatively, the pressure in the control pressure chamber 60 can also be opened by the control unit 86 only during the course of the main injection, so that the second injection valve member 128 opens with a greater delay after the first injection valve member 28 than is shown in FIG. 4. A main injection of a large fuel quantity then ensues through the first injection openings 32 and the second injection openings 132.

It can also be provided that at certain engine operating conditions, especially at low load and/or rpm, when only a slight fuel quantity is injected, that a high pressure is set in the control pressure chamber 60 by the control unit 86 during the preinjection and the main injection over the entire pumping stroke of the pump piston 18, so that only the first injection valve member 28 opens while the second injection valve member 128 remains closed. At high engine load and/or rpm, when a greater fuel quantity is injected, a high pressure can be set in the control pressure chamber 60 by the control unit 86 during the preinjection, so that only the first injection valve member 28 opens, and during the main injection, the pressure in the control pressure chamber 60 can be reduced by the control unit 86, so that in addition the second injection valve member 128 also opens.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, having one high-pressure fuel pump (10) and one fuel injection valve (12), communicating with it, for each cylinder of the engine, wherein the high-pressure fuel pump (10) has a pump piston (18), which is driven by the engine in a reciprocating motion and defines a pump work chamber (22) that communicates with a pressure chamber (40) of the fuel injection valve (12), and the fuel injection valve (12) has at least one first injection valve member (28), by which at least one first injection opening (32) is controlled and which is movable, urged by the pressure prevailing in the pressure chamber 40, counter to a closing force, in an opening direction (29) to uncover the at least one first injection opening (32), and having a control valve (70), actuated by a piezoelectric actuator (84), by which at least indirectly a connection of the pump work chamber (22) with a relief region (78) is controlled, the improvement wherein the first injection valve number (28) is hallow, and wherein the fuel injection valve (12) comprises a second injection valve member (128) guided displaceably inside the hollow first injection valve member (28), by which second injection valve member at least one second injection opening (132) is controlled and which is movable, urged by the pressure prevailing in the pressure chamber (40), counter to a closing force, in the opening direction (29); wherein the second injection valve member (128) is urged in a closing direction at least indirectly by the pressure prevailing in a fuel-filled control pressure chamber (60); and wherein the pressure prevailing in the control pressure chamber (60) is controlled variably as a function of engine operating conditions.

2. The fuel injection system of claim 1, wherein the pressure prevailing in an actuator pressure chamber (80) is controlled by the piezoelectric actuator (84); wherein the control valve (70) has a control valve member (72), which is movable between a closed position, in which the pump work chamber (22) is disconnected from the relief region (78), and an open position, in which the pump work chamber (22) is connected to the relief region (78); and wherein the control valve member (72) is urged in a closing direction by the pressure prevailing in the actuator pressure chamber (80).

3. The fuel injection system of claim 2, wherein the control valve member (72), on its face end remote from the actuator pressure chamber (80), is urged in an opening direction by the pressure prevailing in the control pressure chamber (60).

4. The fuel injection system of claim 3, wherein the control valve member (72) is urged in an opening direction by a restoring spring (82).

5. The fuel injection system of claim 3, wherein the control pressure chamber (60) has a connection (88) with the actuator pressure chamber (80), in which connection a check valve (90) is disposed that opens toward the actuator pressure chamber (80).

6. The fuel injection system of claim 3, wherein the control pressure chamber (60) is defined by a control piston (62), acting on the second injection valve member (128); and that the second injection valve member (128) is additionally urged in the closing direction by a closing spring (144) that is preferably braced on the control piston (62).

7. The fuel injection system of claim 2, wherein the control valve member (72) is urged in an opening direction by a restoring spring (82).

8. The fuel injection system of claim 7, wherein the control pressure chamber (60) has a connection (88) with the actuator pressure chamber (80), in which connection a check valve (90) is disposed that opens toward the actuator pressure chamber (80).

9. The fuel injection system of claim 7, wherein the control pressure chamber (60) is defined by a control piston (62), acting on the second injection valve member (128); and that the second injection valve member (128) is additionally urged in the closing direction by a closing spring (144) that is preferably braced on the control piston (62).

10. The fuel injection system of claim 7, wherein the control pressure chamber (60) is defined by a control piston (62), acting on the second injection valve member (128); and that the second injection valve member (128) is additionally urged in the closing direction by a closing spring (144) that is preferably braced on the control piston (62), and wherein the restoring spring (82) is fastened between the control valve member (72) and the control piston (62).

11. The fuel injection system of claim 2, wherein the control pressure chamber (60) has a connection (88) with the actuator pressure chamber (80), in which connection a check valve (90) is disposed that opens toward the actuator pressure chamber (80).

12. The fuel injection system of claim 2, wherein the control pressure chamber (60) is defined by a control piston (62), acting on the second injection valve member (128); and that the second injection valve member (128) is additionally urged in the closing direction by a closing spring (144) that is preferably braced on the control piston (62).

13. The fuel injection system of claim 1, wherein the control pressure chamber (60) is defined by a control piston (62), acting on the second injection valve member (128); and that the second injection valve member (128) is additionally urged in the closing direction by a closing spring (144) that is preferably braced on the control piston (62).

14. The fuel injection system of claim 1, wherein the pressure in the control pressure chamber (60) is generated by a feed pump (64).

15. The fuel injection system of claim 14, wherein the operation of the feed pump (64) is controlled by a control unit (86) in such a way that this control unit generates the pressure, which is variable as a function of engine operating conditions, in the control pressure chamber (60).

16. The fuel injection system of claim 14, wherein the pressure in the control pressure chamber (60) is adjusted variably as a function of engine operating conditions by an relief valve (66) triggered by a control unit (86).

17. The fuel injection system of claim 1, wherein at low engine load and/or rpm, a high pressure is set in the control pressure chamber (60) so that the second injection valve member (128) remains in its closed position and only the first injection valve member (28) opens and uncovers the at least one first injection opening (32); and wherein at high engine load and/or rpm, a low pressure is set in the control pressure chamber (60), so that in addition, the second injection valve member (128) also opens and uncovers the at least one second injection opening (132).

18. The fuel injection system of claim 1, wherein at the onset of an injection cycle, a high pressure is set in the control pressure chamber (60), so that the second injection valve member (128) remains in its closed position and only the first injection valve member (28) opens and uncovers the at least one first injection opening (32); and wherein in the further course of the injection cycle: a low pressure is set in the control pressure chamber (60), so that in addition, the second injection valve member (128) also opens and uncovers the at least one second injection opening (132).

19. The fuel injection system of claim 18, wherein the injection cycle begins with a preinjection of a slight fuel quantity, during which a high pressure is set in the control pressure chamber (60); and wherein the injection cycle continues with a main injection of a greater fuel quantity, during which a low pressure is set in the control pressure chamber (60).

20. The fuel injection system of claim 19, wherein that a low pressure is not set in the control pressure chamber (60) until during the course of the main injection.

* * * * *